US007789470B2

(12) United States Patent
McCabe

(10) Patent No.: US 7,789,470 B2
(45) Date of Patent: Sep. 7, 2010

(54) DISPLAY CASE FOR COLLECTIBLES

(75) Inventor: Michael P. McCabe, Palm Beach Gardens, FL (US)

(73) Assignee: NSR Displays, Inc., Stuart, FL (US)

( * ) Notice: Subject to any disclaimer, the term of this patent is extended or adjusted under 35 U.S.C. 154(b) by 1228 days.

(21) Appl. No.: 11/353,807

(22) Filed: Feb. 14, 2006

(65) Prior Publication Data

US 2006/0181180 A1 Aug. 17, 2006

Related U.S. Application Data

(60) Provisional application No. 60/652,903, filed on Feb. 14, 2005.

(51) Int. Cl.
*A47F 3/00* (2006.01)

(52) U.S. Cl. ..... 312/114; 312/107; 312/111

(58) Field of Classification Search ..... 312/107, 312/108, 111, 114, 118, 140, 257.1, 265.5, 312/265.6, 198, 234, 234.4; 40/606.08, 611.01, 40/611.06, 611.08

See application file for complete search history.

(56) References Cited

U.S. PATENT DOCUMENTS 143,804 A * 10/1873 Boyle ..... 434/419
870,314 A * 11/1907 Pierce ..... 312/114
1,020,557 A * 3/1912 Hunter ..... 312/114
1,124,345 A * 1/1915 Smith ..... 312/140
2,175,145 A * 10/1939 Davison ..... 439/216
2,279,945 A * 4/1942 Hoffman ..... 312/107
2,582,553 A * 1/1952 McMurtrie ..... 446/121
2,878,090 A * 3/1959 Holderle et al. ..... 312/114
3,115,719 A * 12/1963 Mapson ..... 40/553
3,529,878 A * 9/1970 Blowers ..... 312/107
3,563,624 A * 2/1971 Stice ..... 312/111
3,851,936 A * 12/1974 Muller ..... 312/108
4,322,118 A * 3/1982 Shugart ..... 312/111
4,639,841 A * 1/1987 Salestrom et al. ..... 362/227
4,836,622 A * 6/1989 Ferguson ..... 312/114
4,993,783 A * 2/1991 Omholt ..... 312/119
5,445,552 A * 8/1995 Hine ..... 446/477
5,924,778 A * 7/1999 TenBrink ..... 312/114
2001/0036070 A1* 11/2001 Compagnucci ..... 362/127

* cited by examiner

*Primary Examiner*—James O Hansen
(74) *Attorney, Agent, or Firm*—Fox Rothschild, LLP; Robert J. Sacco

(57) ABSTRACT

Illuminated display case for collectibles that can simulate the look and feel of a collectible's theme. The display case can be modular in design, such that one case can serve as the basis for the joining of additional case modules to form a larger illuminated display. Through the use of a specialized alignment structure, display cases can be lined up one next to the other to form a continuous track around a room.

15 Claims, 7 Drawing Sheets

DISPLAY CASE FOR COLLECTIBLES

CROSS-REFERENCE TO RELATED APPLICATIONS

This application claims the benefit of U.S. provisional application No. 60/652,903, filed Feb. 14, 2005.

BACKGROUND OF THE INVENTION

1. Statement of the Technical Field

The present invention generally relates to a modular display case for collectibles.

2. Description of the Related Art

Acrylic glass boxes and wood cases resembling furniture are the traditional solutions to the problem of displaying various types of collectibles, such as model cars. Model collectible cars come in a variety of scales and typically feature metal bodies, although bodies formed of other materials are also known. In recent years, certain model cars have become available that are authentic replicas of actual vehicles. For example, in the field of auto racing such cars can be purchased with substantial detailing including authentic chassis designs and paint schemes. These types of model cars are available in a variety of styles that accurately replicate both modern and historical race cars.

One limitation faced by collectors is that the current cases for displaying collectibles are relatively uninteresting and do little to enhance the appearance of the collection. As is the case with model car collections, the display cases are merely designed to serve the purpose of preserving the collectible car and do little to resemble a racing environment. Another limitation of such conventional cases is that they come in a predetermined size which limits the number of model vehicles that can be displayed in the case.

Another disadvantage faced by collectors is that their collections tend to increase with time. As a result, the need may arise for a larger display case to house the collection. Considering that a conventional display case is not expandable, such a display case would be undesirable if the collection exceeds the case's capacity. Typical model car display cases are individually placed either side by side or stacked on top of the other. Such configurations do not give the appearance of a unified collection.

Yet, another problem with many existing designs is that they do not offer integrated lighting solutions. Similarly, many conventional display cases also do not feature integrated electrical connections. Such integrated electrical connections can be useful for the purpose of facilitating integrated lighting solutions. If each display case was to have an independent power supply source, an expanded collection could prove rather cumbersome to set up when there are numerous display cases to be illuminated.

For the foregoing reasons, there is a need for an improved display case for collectibles that can easily adapt to increasing collections and that can provide an integrated, themed appearance.

SUMMARY OF THE INVENTION

The present invention provides an improved display case for collectibles that is modular in design and simulates the look and feel of a collectible's theme. The display case can comprise a case having one or more case panels arranged for at least partially enclosing an item to be displayed. One or more of the panels can be at least partially formed of a transparent material. A first and second opposing side panels can be removably connected to the case at opposing ends of the case panels. According to one aspect, the portions of the opposing side panels can be transparent. A first alignment structure can be disposed adjacent to at least one of the opposing ends. The first alignment structure can be adapted for interacting with a second alignment structure of a second display case. The first and second display cases can be aligned to form a single extended display case.

The first alignment structure can be disposed beneath a portion of one or more of the first and second opposing side panels. The first alignment structure can be concealed beneath one or more of the first and second side panels when the first alignment structure is not in use. When the first and second display cases are aligned, an end portion of each of the one or more case panels of the first case can abut an end portion of each of one or more second case panels of the second case.

Each of the first and second display cases can further comprise a display surface on which display items can be placed. An edge portion of the display surface of the first display case can abut an edge portion of the display surface of the second display case when the first and second display cases are aligned. One or more of the case panels can each include at least a front panel, one or more rear panels, and a top panel. An end portion of the front panel, one or more rear panels, and the top panel can abut a corresponding end portion of a front panel, a rear panel, and a top panel of the second display case when the first and second cases are aligned.

According to one aspect, one or more of the case panels can be sized and shaped to conform to a corner display configuration that extends the display case around corners. For the corner display configuration, two of the rear panels can be positioned transversely to each other.

The first alignment structure and the second alignment structure can each include one or more apertures. One or more alignment fasteners can be adapted to be received by opposing apertures from abutting the first and second alignment structures when the first and second display cases are aligned in abutment. Thus, one or more of the alignment structures can be disposed adjacent to opposing ends of the case panels.

The display case can further comprise a display surface on which display items can be placed. According to one aspect, the display surface can be stepped to define a multi-level surface for improved display of collectibles. However, in another aspect, the display surface can be banked to define a simulated track defining at least one of a road and a playing field. One or more of the case panels can further include a securing device. The securing device can define at least one channel for retaining a background display panel.

The display case can further comprise one or more light sources that can be disposed along a length of the simulated track. One or more of the light sources can be comprised of light emitting diodes (LEDs). The display case can further comprise one or more electrical connectors that can be integrated within a portion of the display case that is adjacent to the opposing ends of the case panels. According to one aspect, the electrical connector can form a portion of the alignment structure.

According to another embodiment of the invention, a display case for collectibles can comprise a case having one or more case panels that can be arranged for at least partially enclosing an item to be displayed. One or more of the case panels can be at least partially formed of a transparent material. A first and second opposing side panels can be removably connected to the case at opposing ends of the case panels. A first alignment structure can be disposed adjacent to one or more of the opposing ends. The first alignment structure can be adapted for interacting with a second alignment structure of a second display case. The first and second display cases can be aligned to form a single extended display case. In addition, one or more of the plurality of case panels can be sized and shaped to conform to a corner display configuration that can extend the display case around corners. To maintain a corner display configuration, two of the rear panels can be positioned transversely to each other.

In yet another embodiment of the invention, a display case for collectibles can comprise a case having one or more case panels that can be arranged for at least partially enclosing an item to be displayed. One or more of the case panels can be at least partially formed of a transparent material. A first and second opposing side panels can be removably connected to the case at opposing ends of the case panels. A first alignment structure can be disposed adjacent to one or more of the opposing ends. The first alignment structure can be adapted for interacting with a second alignment structure of a second display case. The first and second display cases can be aligned to form a single extended display case when abutting side panels of the first and second display cases have been removed. One or more electrical connectors can be integrated within a portion of the display case adjacent to the opposing ends of the case panels. The electrical connector(s) can form a portion of the alignment structure.

BRIEF DESCRIPTION OF THE DRAWINGS

Preferred embodiments of the present invention will be described below in more detail, with reference to the accompanying drawings, in which.

DETAILED DESCRIPTION OF THE PREFERRED EMBODIMENTS

Figure 1:
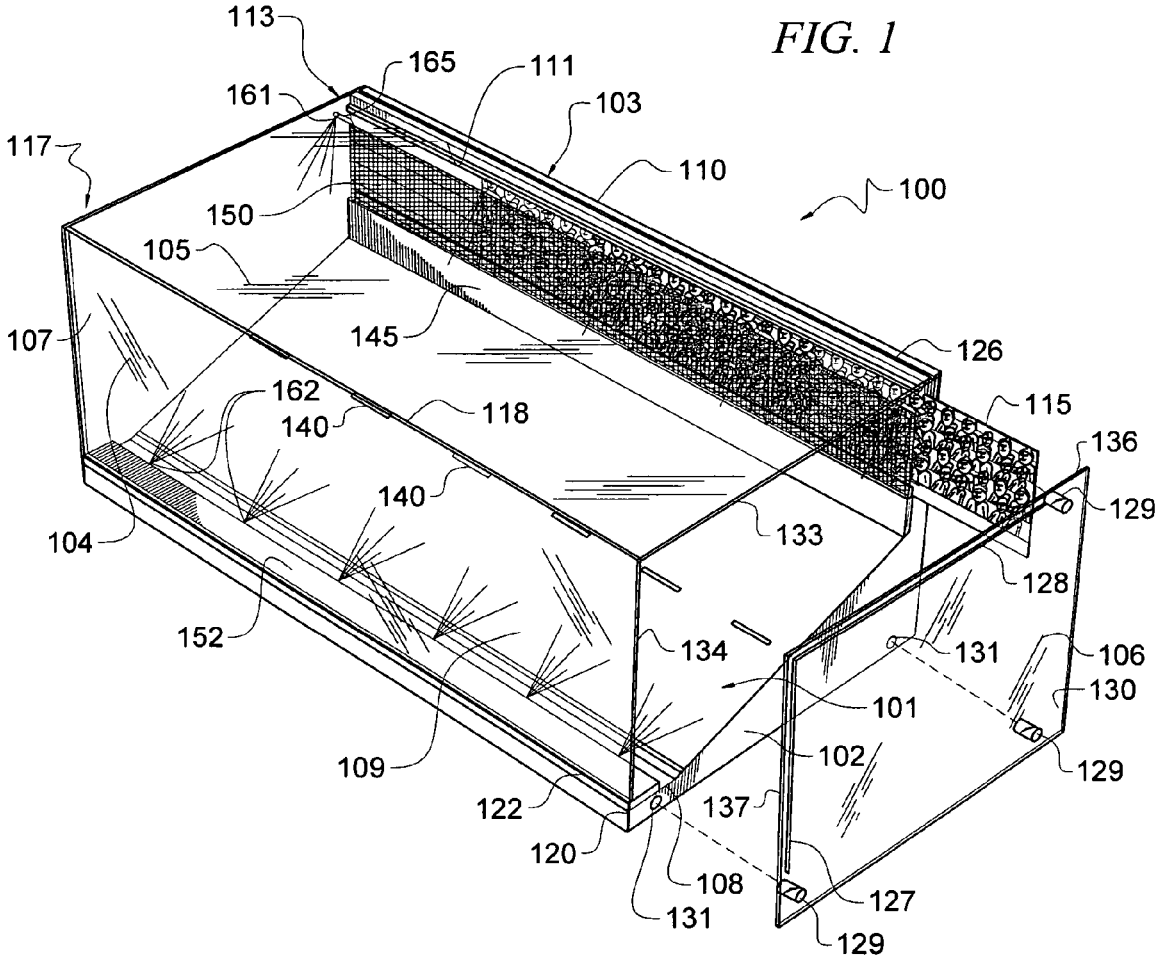
FIG. 1 is a perspective view of a first embodiment of a display case in a straightaway configuration that is useful for understanding the invention.

The present invention concerns modular display cases. The display cases can form either a straight or a curved configuration. Referring to FIG. 1, the display case 100 with a straight configuration can be formed such that a display surface 101 resembles a straight section of a playing field such as an automobile race track. The general structure of the display case 100 includes a base 102, a rear panel 103, a front panel 104, a top panel 105, and a set of opposing right and left side panels 106, 107.

Figure 2:
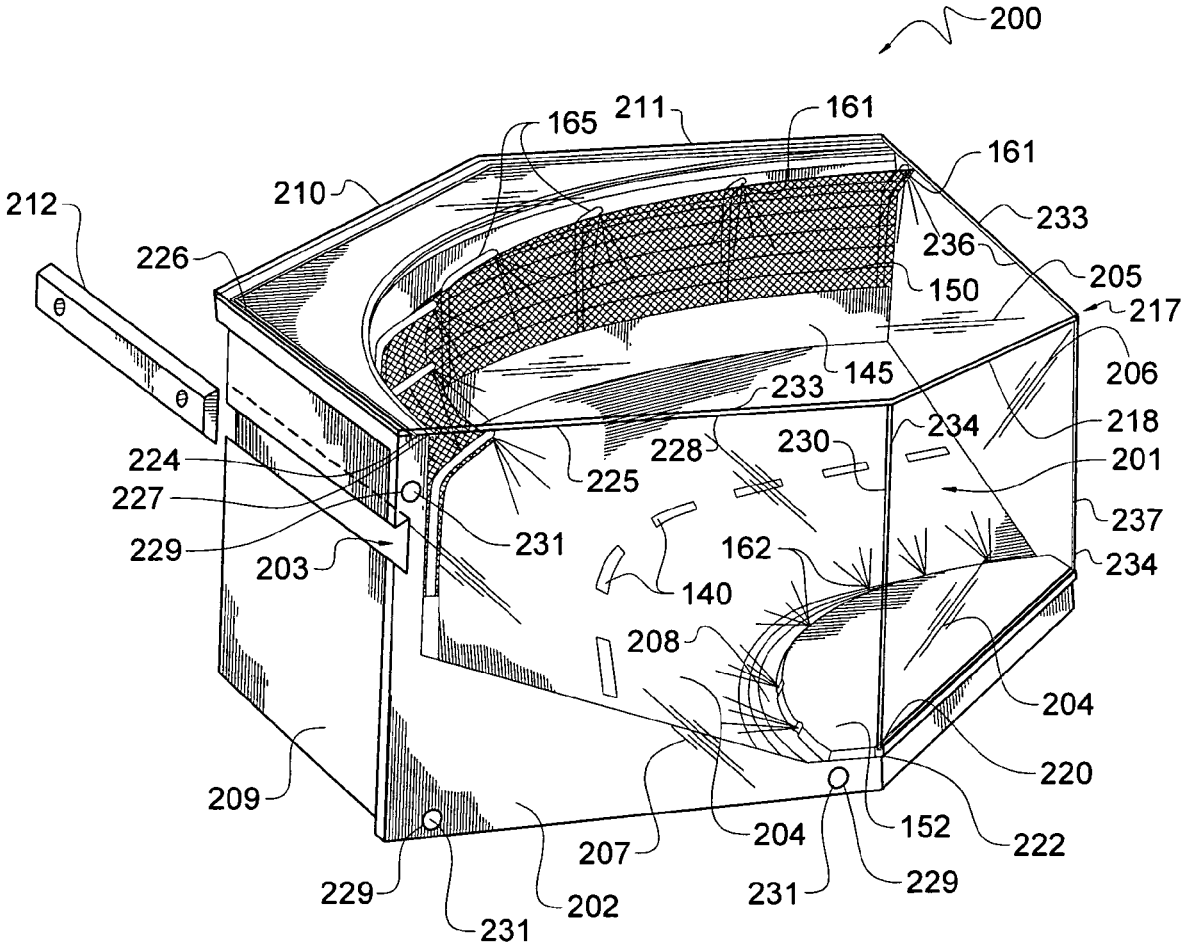
FIG. 2 is a perspective view of the display case in a corner display configuration that is useful for understanding the invention.

Referring now to FIG. 2, it can be observed that a display case 200 with a curved configuration can be formed so that a display surface 201 resembles a curved section of a playing field or track. Display case 200 generally includes a base 202 and a set of opposing right and left side panels 206, 207. The display case 200 includes rear panels 209, 210, 211, a display surface 204, and a set of front and top panels 204, 205 to create a corner display configuration. Display case 200 can be used in corners of a room. The display case 200, in combination with the display case 100, can facilitate the formation of a continuous oval or round track/playing field around a perimeter of a room.

The display cases 100, 200 are designed to enhance the themed appearance of any type of collectible, particularly for displaying model race cars. For illustrative purposes, the specification shall generally provide examples pertaining to a racetrack theme. However, the examples are not intended to limit the scope of the claimed invention.

Referring again to FIG. 1, it can be observed that the display surface 101 can have a banked configuration. In particular, the display surface 101 can extend between a rear panel 103 and an infield area 152 as shown. The display surface 101 can be formed at an angle relative to a plane defined by an infield area 152. For example, this angle can be between about 5° to 60° to simulate the appearance of a banked race track. According to one embodiment, this angle can be between about 10° and 40°. In this regard, it will be appreciated that the display surface 101 can also be inclined relative to a plane defined by a portion of rear panel 103. For example, the display surface 101 can form an angle of between about 95° to 150° relative to a plane defined by back portion 110 of rear panel 103. Still, the invention is not limited in this regard and other banked track configurations are also possible. According to one embodiment of the invention, the display surface 101 can resemble a real automobile raceway and can allow substantially unobstructed visibility with regard to model race cars placed on the track.

Figure 3:
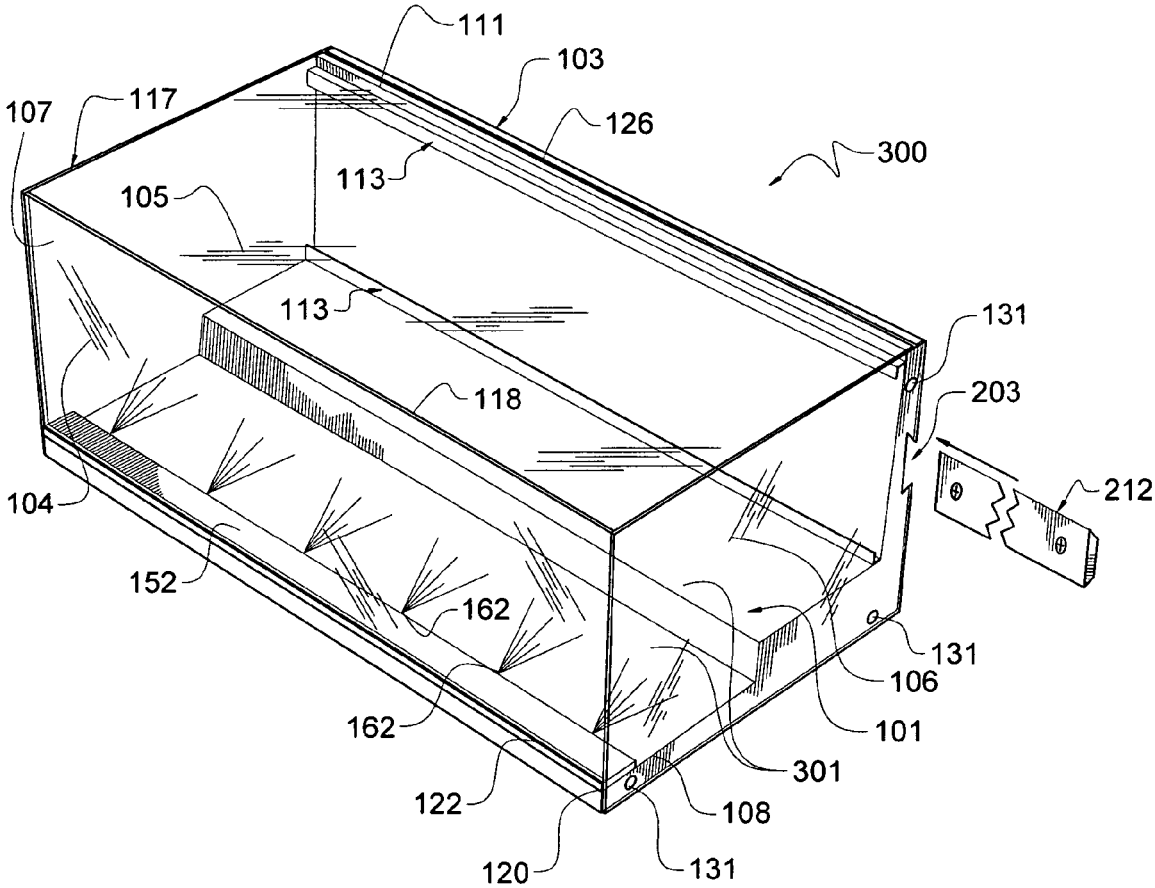
FIG. 3 is a perspective view of a second embodiment of a display case in a straightaway configuration that is useful for understanding the invention.
Figure 4:
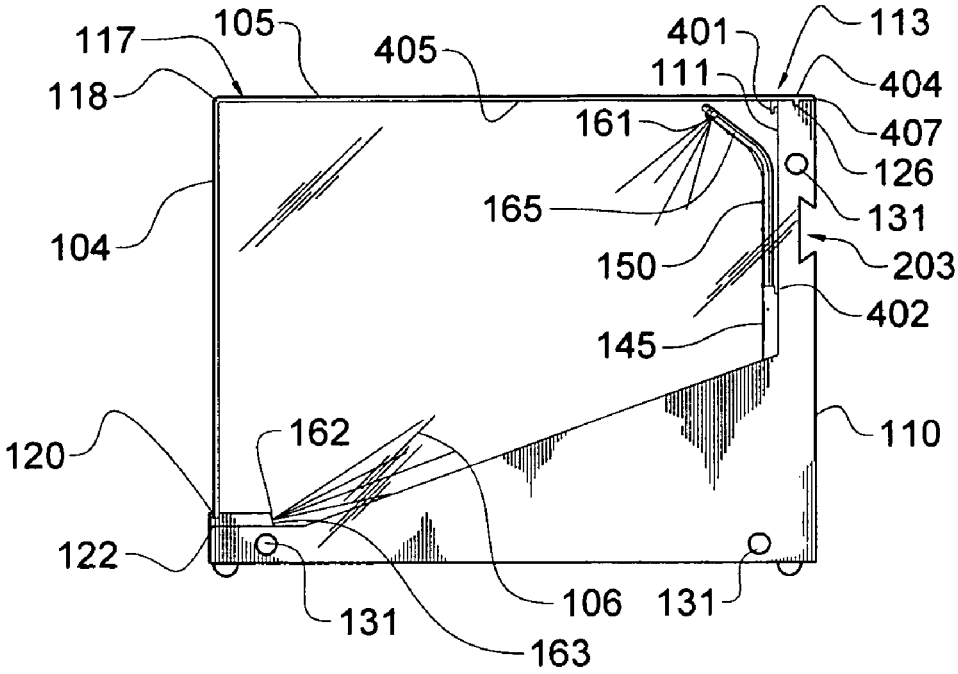
FIG. 4 is a right side elevational view of the display case in FIG. 1.
Figure 5:
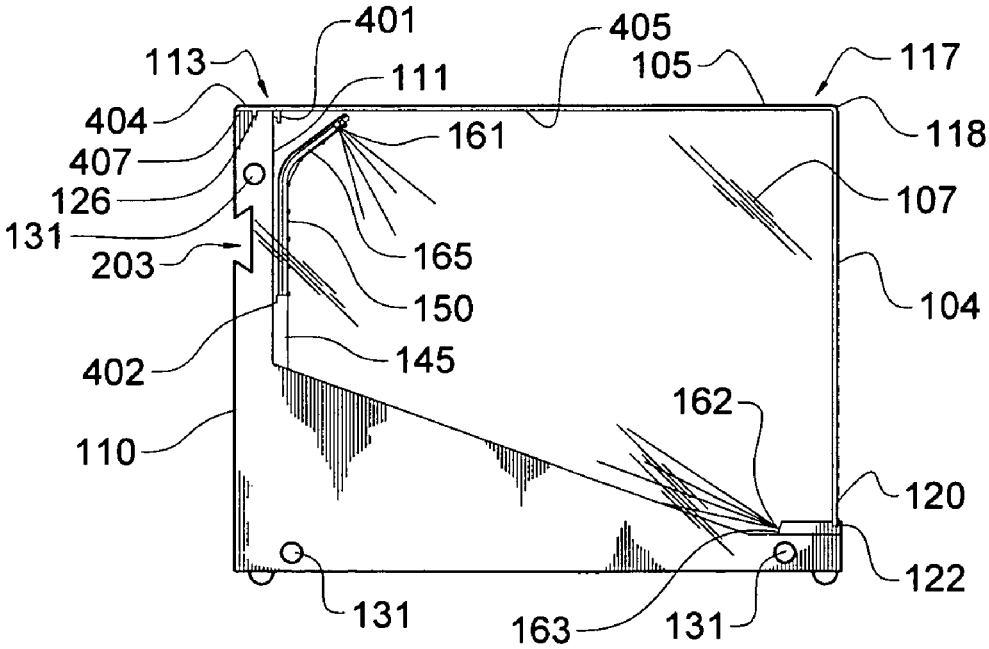
FIG. 5 is a left side elevational view of the display case in FIG. 1.

According to another embodiment of the display case 300, shown in FIG. 3, the display surface 101 can also have a stepped configuration 301. The stepped display surface 301 can facilitate greater visibility of collectibles that can be positioned towards the rear of the case 300 or behind other collectibles. The stepped display surface 301 can also allow other type of collectibles to be easily placed in an upright position by resting on a flat display surface. As can be seen from the previous embodiments, the particular profile of the display surface 101, 201 is not critical, as long as a collectible or collectibles can be suitably positioned on the display surface 101, 201.

The display case 100 can also include a plurality of case panels defining a cover 117. The cover can prevent dust and dirt from damaging the model vehicles displayed in the case. According to one embodiment of the invention, the cover 117 can be removable by a user to facilitate access to the interior of the case. As shown in FIGS. 1, and 3-5, the cover 117 can be formed by the combination of a front panel 104 and a top panel 105. Both front 104 and top 105 panels can be attached to one another along an attachment line 118. The front panel 104 can be secured to the base surface 108 by inserting a bottom edge 120 of the front panel 104 into a base panel groove 122 located on the base surface 108.

The top panel 105 can be secured to the rear panel 103 by inserting a top panel tab 124 into a rear panel groove 126. According to FIGS. 4-5, the top panel tab 404 can be attached to and protrude from an underside surface portion 405 of the top panel 105. The top panel tab 404 can be shaped as a narrow, raised ridge that extends along the length of the top panel 105. However, the invention is not limited in this regard, so long as the top panel tab 404 is configured to fit within a rear panel groove 126. The rear panel groove 126 is sized and shaped to mate with the top panel tab 404. The rear panel groove 126 extends along the length of a top surface 407 of the rear panel 103. However, the invention is not limited in this regard, and any other attachment arrangement can also be used. According to an embodiment, the cover 117 can be at least partially formed from a transparent material. For example, the cover 117 can be made from a transparent acrylic material, a transparent polymer, glass or any other suitable material.

A pair of opposing side panels 106,107 can be used in combination with the cover 117, base panel 102, and rear panel(s) 103 to enclose collectibles within the display case 100. FIG. 1 illustrates one possible example of a removable side panel arrangement for the display case 100. As illustrated in FIG. 1, the side panels 106, 107 have a series of rod elements 129 that protrude from an inner surface portion 130 of the side panels 106 and 107 (not viewable). The rod elements 129 can be sized and shaped to fit snugly within apertures 131. Alternatively, or in addition to the rod elements 129, the side panels 106, 107 can also have a horizontal ridge 128 and a vertical ridge 127 that are respectively configured for frictionally engaging an inner portion of a horizontal and a vertical edge 133, 134 of the cover 117. The horizontal and vertical ridges 128, 127 extend respectively along a top edge 136 and a front edge 137 of the side panels 106, 107. However, the invention is not limited in this regard, and any other attachment arrangement can also be used. The opposing side panels 106, 107 can be at least partially formed from a transparent material to enhance the display of the collectible. For example, the side panels 106, 107 can be made from a transparent acrylic material, a transparent polymer, glass, or any other suitable material.

Figure 7:
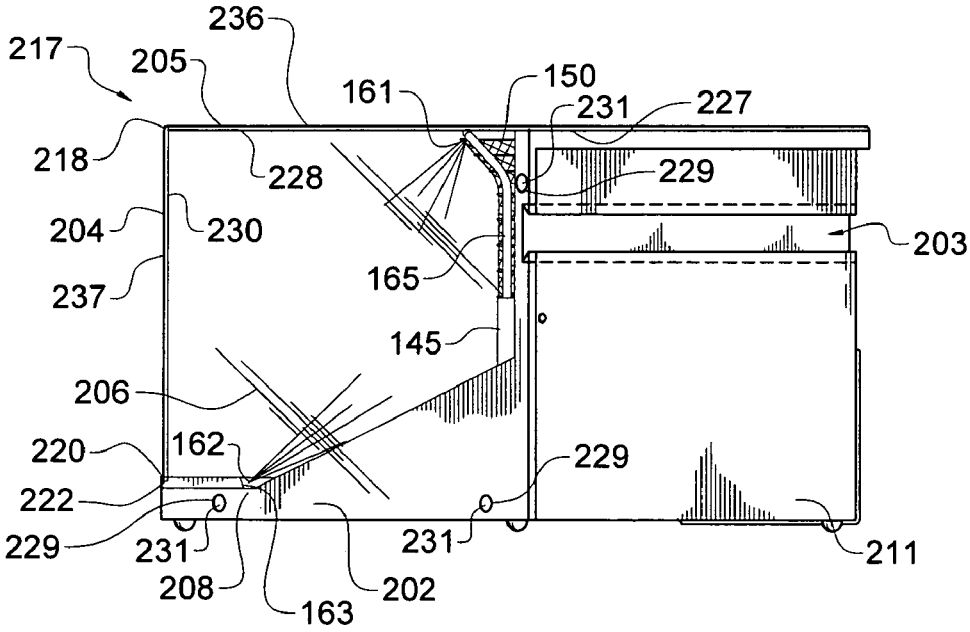
FIG. 7 is a right side elevational view of the display case in FIG. 2.
Figure 8:
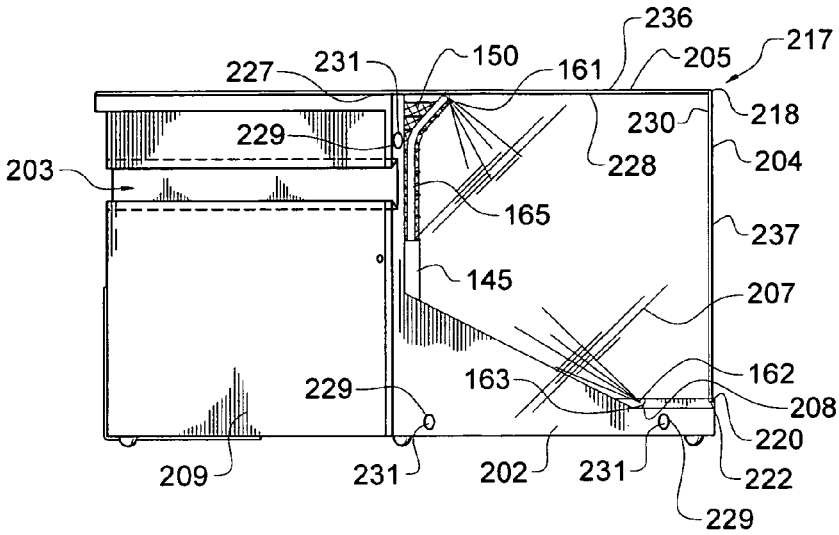
FIG. 8 is a left side elevational view of the display case in FIG. 2.

The display case 200, shown in FIGS. 2 and 7-8, can be formed from two or more rear panels 209-211 that can be attached to one another at an angle. Advantageously, at least two of the panels 209, 211 can be arranged at about 90° with respect to each other to facilitate mounting the display case 200 in the corner of a room. In the display configuration shown in FIG. 2, a left rear panel 209 and a right rear panel 211 are at right angles with each other. The middle rear panel 210, which connects the left and right rear panels 209, 211, forms an angle of about 135° or 225° with each of the left and right rear panels 209, 211. The number of additional panels used to form the curved track configuration is not critical to the invention and any number of panels can be used to form the curved display case 200.

The display case 200 can also include a plurality of case panels defining a cover 217. According to one embodiment, the cover can be removable. The cover can prevent dust and dirt from damaging the model vehicles displayed in the case. As shown in FIGS. 2, and 7-8, the cover 217 can be formed by the combination of a front panel 204 and a top panel 205. Both front 204 and top 205 panels can be attached to one another along an attachment line 218. The front panel 204 can be secured to the base surface 208 by inserting a bottom edge 120 of the front panel 204 into a base panel groove 222 located on the base surface 208.

The top panel 205 can be secured to the rear panels 209, 210, 211 by inserting a top panel tab 224 into a rear panel groove 226. The top panel tab 224 can be attached to and protrude from an underside surface portion 225 of the top panel 205. The top panel tab 224 can be shaped as a narrow, raised ridge that extends along the length of the top panel 205. However, the invention is not limited in this regard. The rear panel groove 226 is sized and shaped to mate with the top panel tab 224. The rear panel groove 226 extends along the length of a top surface 227 of the rear panels 209, 210, 211. However, the invention is not limited in this regard, and any other attachment arrangement can also be used. According to an embodiment, the cover 217 can be at least partially formed from a transparent material. For example, the cover 217 can be made from a transparent acrylic material, a transparent polymer, glass or any other suitable material.

A pair of opposing side panels 206, 207 can be used in combination with the cover 217, base panel 202, and rear panels 209, 210, 211 to enclose collectibles within the display case 200. FIG. 2 illustrates one possible example of a removable side panel arrangement for the display case 100. Similar to the illustration in FIG. 1, the display case 200 can have side panels 206, 207 having a series of rod elements 229 that protrude from an inner surface portion 130 of the side panels 206 (not viewable) and 207. The rod elements 229 can be sized and shaped to fit snugly within apertures 231. Alternatively, or in addition to the rod elements, the side panels 206, 207 can also have a horizontal ridge 228 and a vertical ridge 230 that are respectively configured for frictionally engaging an inner portion of a horizontal and a vertical edge 233, 234 of the cover 217. The horizontal and vertical ridges 228, 230 extend respectively along a top edge 236 and a front edge 237 of the side panels 206, 207. However, the invention is not limited in this regard, and any other attachment arrangement can also be used. The opposing side panels 206, 207 can be at least partially formed from a transparent material to enhance the display of the collectible. For example, the side panels 206, 207 can be made from a transparent acrylic material, a transparent polymer, glass, or any other suitable material.

The display case 200, shown in FIGS. 2 and 7-8, can be formed from two or more rear panels 209-211 that can be attached to one another at an angle. Advantageously, at least two of the panels 209, 211 can be arranged at about 90° with respect to each other to facilitate mounting the display case 200 in the corner of a room. In the display configuration shown in FIG. 2, a left rear panel 209 and a right rear panel 211 are at right angles with each other. The middle rear panel 210, which connects the left and right rear panels 209, 211, forms an angle of about 135° or 225° with each of the left and right rear panels 209, 211. The number of additional panels used to form the curved track configuration is not critical to the invention and any number of panels can be used to form the curved display case 200.

Display cases 100, 200 share several common elements. Themed elements can be included for simulating a theme of a collectible. A wall bracket can be used to mount display cases 100, 200 onto a wall. An alignment structure can be used to suitably align one display case with another. Each display case can include an alignment structure to suitably align two or more conjoined cases. A lighting system is used to illuminate collectibles within the display cases 100, 200.

According to several embodiments of the invention shown in FIGS. 1 and 2, the display case 100, 200 can include additional detail features so that it more closely resembles a section of a racetrack. For example, the display surfaces 101, 201 can be painted black, grey or any other suitable color so as to resemble asphalt or pavement. Appropriate striping 140 can be provided to delineate one or more lanes of the racetrack. The display surface 101 can also include various textures to reflect the theme of the collectibles. For example, a racetrack theme can include a rough texture to simulate an asphalt surface. A rear wall 145 can also be painted or have detail added to appear more like a real race track. For example, a scale version of a security fence 150 can be provided. The security fence 150 can be configured as a chain link fence that extends vertically from the rear wall 145. An infield area 152 can be painted or otherwise detailed to appear as turf. However, the invention is not limited in this regard.

Those skilled in the art will appreciate that the display cases 100, 200, and 300 described herein can be formed in a variety of sizes. Referring back to the race track themed embodiment, the display case can be designed to have two lanes, three lanes or four lanes, without limitation. The size of the case can also be scaled to accommodate all scales of collectibles. For example, model car scales can include a 1:18 Scale, 1:24 Scale, and 1:64 Scale.

Referring now to FIGS. 1 and 3-6, it can be observed that the back portion 110 of the rear panel 103 may be formed of a continuous linear panel 103. The front portion 111 of the rear panel 103 can include a securing device 113. The securing device 113 can include a structure suitable for removably securing a background display panel 115. The background display panel 115 can be a thin rectangular sheet that includes a themed graphic design. According to one embodiment of the straight display case shown in FIGS. 4-5, the securing device 113 can include an upper track 401 and a lower track 402 having a channel with an 'L' shaped cross-sectional profile. The channels associated with the upper and lower tracks 401, 402 are configured for securing the background display panel 115. The background display panel 115 can be profiled such that it can slide in or out of the channels, thereby allowing for interchangeability of background themes. An example of the mating interaction between the background display panel 115 and the securing device 113 is shown in FIG. 1. The securing device can be included in both straight and curved display cases 100, 200.

As mentioned earlier, those skilled in the art will appreciate that the display cases 100, 200, 300 disclosed herein can include different background themes. Background themes that can be used include, but are not limited to, sports grandstand/stadium, fans, dusk, night, and day. In effect, any background theme can be used depending on the type of collection that is being housed. The display surface 101 can also contain any type of ornamentation, color, or texture, depending on the type of collection. For example, if the case were to house model race cars, the display surface could reflect a race track theme. However, the display case can have other non-tracked sports themes. These themes include, but are not limited to, baseball, basketball, football, golf, hockey, soccer, and tennis.

Figure 9:
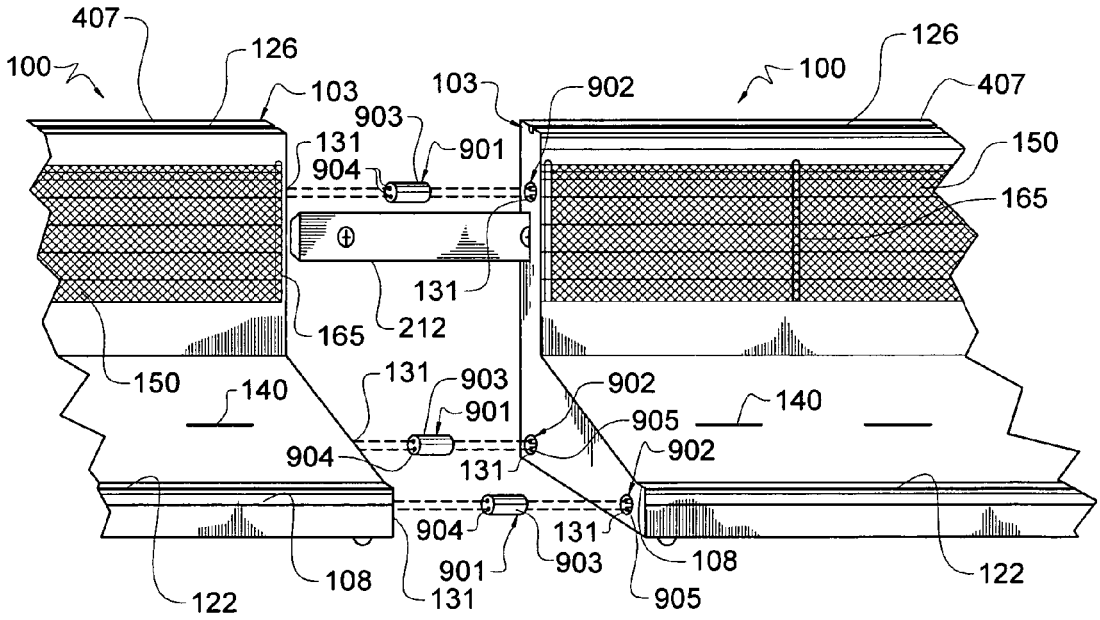
FIG. 9 is a perspective view of conjoined straightaway display cases that is useful for understanding the invention.

Referring now to FIGS. 2, 3, and 9, it can be observed that the display case 100, 200, 300 can also include a mounting system for attaching the display case to a wall. The particular design of the bracket system is not critical provided that the bracket system can releasably secure a display case to a wall(s). For example, a wall bracket 212 can be designed to engage a bracket channel 203 formed on a rear surface of the display cases 100, 200, 300.

Figure 6:
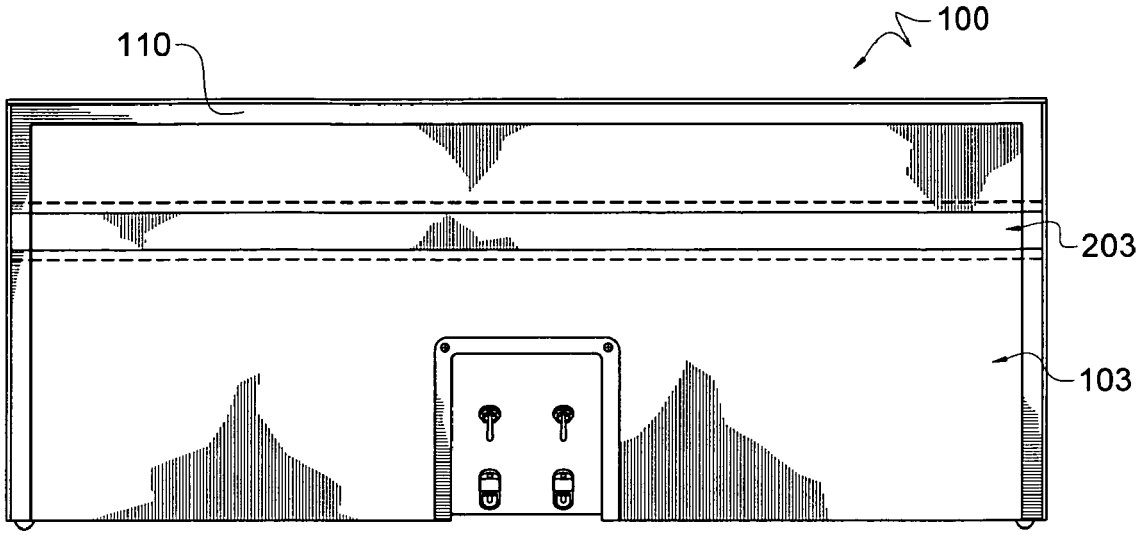
FIG. 6 is a rear elevational view of the display case in FIG. 1.

In the example shown in FIGS. 2, 6, and 9, the bracket system can include a wall bracket 212 that is mounted to a wall. The wall bracket 212 can have a cross-sectional profile that is configured to securely and slidably mate within the bracket channel 203 formed with the same cross-sectional profile. For example, the cross-sectional profile of the wall bracket 212 and bracket channel 203 can be trapezoidal with outwardly tapered sides. It should be understood that the invention is not limited to this mounting configuration and other mounting configurations with different sizes and shapes can be implemented. The wall bracket 212 and bracket channel 203 can also facilitate alignment of two conjoined display cases. Additional information relating to the alignment of conjoining display cases will be discussed below in greater detail.

The display cases can also each include an alignment structure to ensure that the display cases are aligned vertically and horizontally with one another, producing a more realistic appearance of an extended display case. Any suitable structure can be used for this purpose. For example, the alignment structure can include one or more interlocking structures. As shown in FIG. 9, the interlocking structures can be defined by a male alignment member 901 and a female alignment member 902, which interlock such that two or more display cases can be conjoined.

According to one embodiment shown in FIG. 9, the female alignment member 902 can be defined by aperture(s) 131 that can be placed opposite to one another on abutting side portions 902 of the display cases 100. The aperture 131 can be of any size or shape so long as the male alignment member 901 can snugly fit within the apertures 131. According to the embodiment illustrated in FIG. 9, the apertures 131 can have a circular cross-section which defines the opening of a bore. The male alignment member 901 can have a rod-like structure with a cross-section that matches the aperture(s) 131. It should be appreciated that the invention is not limited to the actual location of these interlocking structures.

According to the embodiment shown in FIG. 9, the male alignment member 901 can be defined by an alignment pin 903. The alignment pin 903 can be of any size and shape so long as it can interlock with the aperture(s) 131. The alignment pin 903 can have a cylindrical shape such that it can be inserted within the aperture(s) 131. The one or more alignment pins 903 can be adapted to be received by opposing apertures 131. The alignment pin can be inserted in the aperture(s) 131 to provide vertical and horizontal alignment of the infield edge of the display case. However, the invention is not limited to this type of interlocking structure configuration.

As noted earlier, the bracket system can also facilitate the alignment of two or more display cases. For example, the wall bracket 212 can be sized and shaped to be inserted within two or more bracket channels 203 simultaneously, as shown in FIG. 9. In order for this alignment to take effect, the bracket channels 203 should be aligned end to end such that the wall bracket 212 can traverse the bracket channels 203 simultaneously. Such an alignment ensures that the conjoined display cases are aligned vertically and horizontally with one another.

It can be appreciated that the side panels 106, 107 and/or 206, 207 can disrupt the appearance of a continuous display case if several display cases 100 and/or 200 are joined together to form a larger case. For example, if the display case is designed to simulate a racetrack, the continuity of the racetrack could be interrupted by the side panels 106, 107, 206, and/or 207. In order to avoid this undesirable effect associated with conjoined display cases, opposing side panels 106, 107, 206, 207 can be designed so that they are removable. The removal of the opposing side panels can facilitate the task of connecting together two or more cases end to end. Such an arrangement can allow the two or more cases to become one, simulating the appearance of a longer display case. In the case of model race cars, the arrangement could simulate a longer stretch of racetrack.

Figure 10:
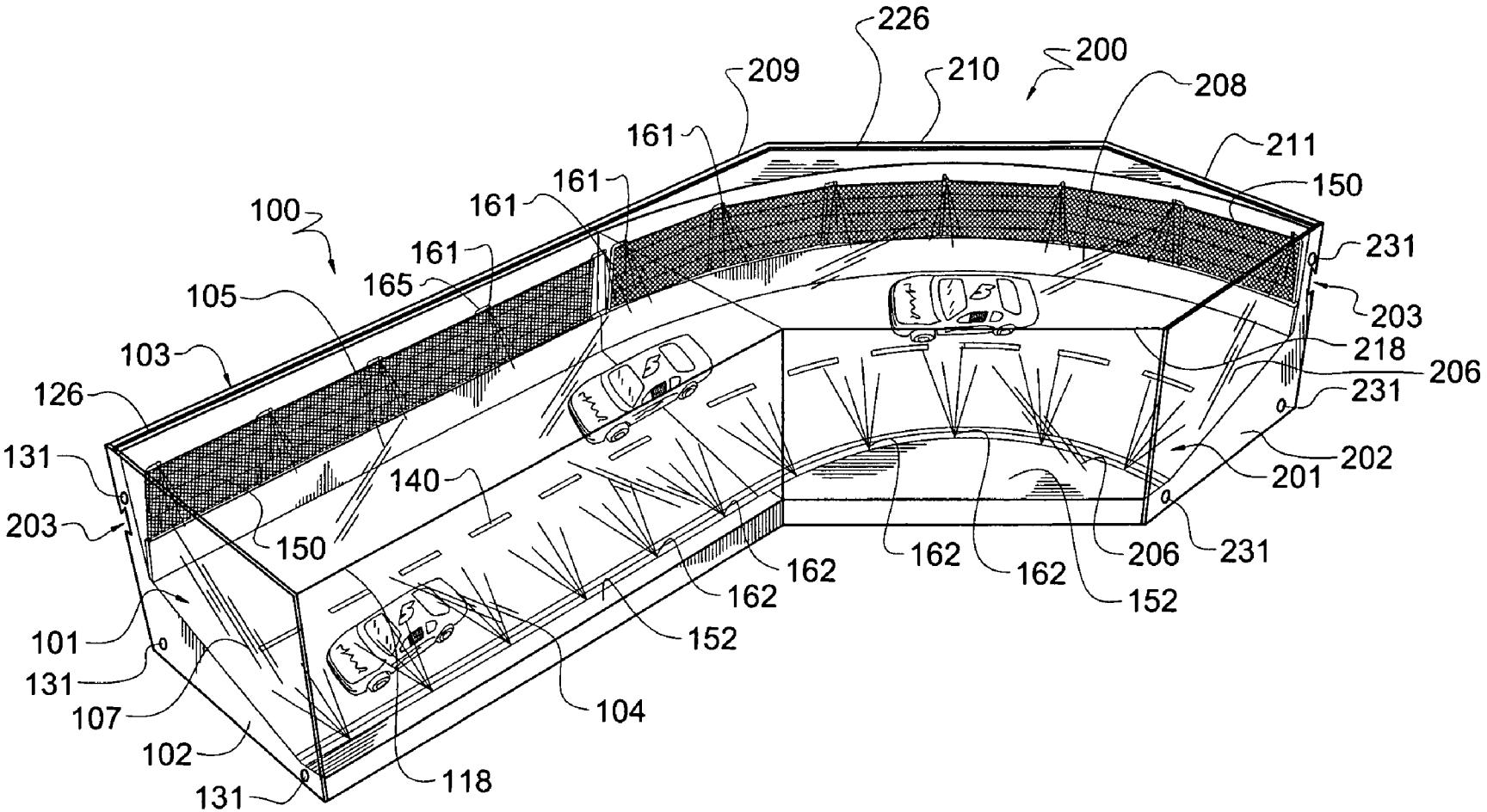
FIG. 10 is a perspective view of conjoined straightaway and curved display cases that is useful for understanding the invention.

FIG. 10 shows how the straight display case 100 and the curved display case 200 can be conjoined to simulate the appearance of a longer display case. Note how the side panels 106, 207 corresponding to the abutting ends of display cases 100, 200 have been removed. However, the side panels 107, 206 located at the extreme ends of the conjoined display cases could still be attached to conceal the alignment structures at those extreme ends, thus fully enclosing the collectibles within the extended display case.

As shown in FIGS. 1-2, 4-5, and 7-8, the display case 100, 200 can also include an integrated lighting system. For example, a first set of miniature lights 161 can be provided at a location on or near the rear panel(s) 103 and a second set of miniature lights 162 can be provided at the base surface 108 of the display case 100. According to one embodiment shown in the FIGS. 1, 2, 4-5, and 7-8, the first and second set of miniature lights 161, 162 can be formed from light emitting diodes (LEDs), which are well known in the art. However, the lighting system can use any type of light source as long as the power supply meets the voltage and current requirements and the light's size is sufficiently small to fit within the display case. For example, miniature halogen or incandescent bulbs can be used for this purpose.

According to the embodiments of the invention shown in FIGS. 1-2, 4-5, and 7-8, the first set of LED lights can be integrated into poles 165. For example, the first set of miniature lights 161 can be installed at a tip end of poles 165 distal from the display surface. By employing a lighting system that includes LEDs integrated into poles 165, the collectible race cars can be better displayed within the case without obtrusive lighting from conventional light fixtures that are inconsistent with a racetrack theme. Similarly, the second set of miniature lights 162 can be positioned on a tapered edge 163 of the infield area 152, opposed from panel 104, 204. Such an arrangement can minimize the appearance of lighting fixtures inconsistent with the racetrack theme.

The light sources can be designed to produce any color of light. However, white light can present a more natural appearance. According to one embodiment of the invention, the miniature lights can be formed of white LEDs. Further, the miniature lights can be selected and positioned so that the light they produce is directed in a particular direction or pattern, e.g. toward the display surface 101, the collectibles, or both. According to a preferred embodiment, the lights can be selected to be LEDs that emit light at a particular angle that is directed generally toward the display surface 101, 201 for illuminating the collectibles placed thereon.

Suitable circuitry can be provided to power the miniature lights. The circuitry can include wiring, light sockets, circuit boards, and the like suitable for powering the lights. If the lights are designed to run on a low voltage DC, a suitable power supply can be provided. The power supply can be integrated with the display case 100, 200, 300 or can reside as a separate module.

The invention can include circuitry that can allow electrical current to pass from one display case to another display case. According to an embodiment of the invention illustrated in FIG. 9, electrical connectors can be disposed on at least one end of each display case. For example, the alignment pin 903 can include a female electrical connector 904 that connects with two opposing male electrical connectors 905 attached to either side of the abutting cases 100. The two opposing male electrical connectors 905 can be recessed within the apertures 131. Alternatively, any other suitable connector can be provided on display cases 100, 200 to facilitate distribution of electric power to one or more display cases.

It should be understood that the invention is not limited to any particular electrical configuration, so long as it is capable of handing the voltage and current demands of the one or more display cases. As an alternative embodiment to the one shown in FIG. 9, a male electrical connector can be provided on a first case that will mate with a female electrical connector on a second case.

While specific embodiments of the invention have been disclosed, it will be appreciated by those skilled in the art that various modifications and alterations to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A display case for collectibles comprising:

a base structure including an elongated surface on which an item to be displayed can be placed;

first and second end faces formed at opposing ends of said base transverse to said elongated surface;

a plurality of case panels arranged for at least partially enclosing said item to be displayed, said plurality of case panels including a back panel integrally formed with said base structure and extending transverse to said elongated surface along a rear edge thereof;

a top panel supported on an upper elongated edge of said back panel, said top panel at least partially formed of a transparent material, and extending over said elongated surface in a first direction transverse to said back panel;

first and second opposing side panels removably connected to the case at said opposing ends of said base structure;

a first channel defined by at least one track formed on a front face of said back panel;

at least one decorative panel having a selected design formed on at least one surface thereof, said decorative panel removably disposed in said first channel and positioned so that said selected design is facing away from said back panel, toward a front of said display case;

a first alignment structure disposed in said base structure at each of said first and second end faces, said first alignment structure adapted for interacting with a second alignment structure of a second case, wherein said case and said second case can be aligned to form a single extended display case;

a plurality of posts; and a mesh material coupled to said posts to form a fence, said fence extending adjacent to said decorative panel.

2. The display case according to claim 1, wherein said first alignment structure is disposed beneath a portion of at least one of said first and second opposing side panels, when the first alignment structure is not in use.

3. The display case according to claim 1, wherein an end portion of each of said plurality of case panels of said case abuts an end portion of a plurality of case panels of said second case, and an end face of said case abuts an end face of said second case, when said case and said second cases are aligned.

4. The display case according to claim 3, wherein said plurality of case panels further includes a front panel opposed from said back panel, extending transversely between said top panel toward said base structure.

5. The display case according to claim 4, wherein an end portion of each said front panel, said back panel, and said top panel of said case abuts a corresponding end portion of a respective case panel of said second case when said case and said second cases are aligned.

6. The display case according to claim 1, wherein the first alignment structure and the second alignment structure each include a plurality of apertures formed in said end faces, whereby a plurality of alignment fasteners is adapted to be received by opposing apertures from abutting first and second alignment structures when said case and said second case are aligned in abutment.

7. The display case according to claim 1, wherein said display surface is banked to define a simulated track defining at least one of a road and a playing field.

8. The display case according to claim 7, further comprising a plurality of light sources disposed along a length of said simulated track.

9. The display case according to claim 8, wherein each of the plurality of light sources is comprised of at least one LED.

10. The display case according to claim 1, further comprising at least one electrical connector integrated within a portion of said case adjacent to said opposing ends of said plurality of case panels.

11. The display case according to claim 10, wherein said electrical connector forms a portion of said first alignment structure.

12. The display case according to claim 1, wherein a portion of each of the first and second opposing side panels is at least partially transparent.

13. The display case according to claim 1, further comprising a second channel aligned with said first channel and formed on a rear face of said back panel opposed from said front face, said second channel having a size and shape configured for receiving a bracket for attaching said case to a support surface.

14. A display case for collectibles comprising:

a base structure including an elongated surface on which an item to be displayed can be placed;

first and second end faces formed at opposing ends of said base transverse to said elongated surface;

a plurality of case panels arranged for at least partially enclosing said item to be displayed, said plurality of case panels including a back panel integrally formed with said base structure and extending transverse to said elongated surface along a rear edge thereof;

a top panel supported on an upper elongated edge of said back panel, said top panel at least partially formed of a transparent material and extending over said elongated surface in a first direction transverse to said back panel;

first and second opposing side panels removably connected to the case at said opposing ends of said base structure;

a first channel defined by at least one track formed on a front face of said back panel;

at least one decorative panel having a selected design formed on at least one surface thereof, said decorative panel removably disposed in said first channel and positioned so that said selected design is facing away from said back panel, toward a front of said display case;

a first alignment structure disposed in said base structure at each of said first and second end faces, said first alignment structure adapted for interacting with a second alignment structure of a second case, wherein said case and said second case can be aligned to form a single extended display case when abutting side panels of the case and second cases have been removed;

at least one electrical connector integrated within a portion of said case adjacent to said opposing ends of said plurality of case panels, the electrical connector forms a portion of said first alignment structure;

a plurality of posts; and a mesh material coupled to said posts to form a fence, said fence extending adjacent to said decorative panel.

15. A first display case for collectibles comprising:

a base structure including an elongated surface on which an item to be displayed can be placed, said elongated surface banked to increase in elevation from a front to a rear of said display case;

first and second end faces formed at opposing ends of said base transverse to said elongated surface;

a plurality of case panels arranged for at least partially enclosing said item to be displayed, said plurality of case panels including a back panel integrally formed with said base structure and extending upwardly in a direction transverse to said elongated surface along a rear edge thereof;

a top panel supported on an upper elongated edge of said back panel, said top panel at least partially formed of a transparent material, and extending over said elongated surface in a first direction transverse to said back panel;

first and second opposing side panels removably connected to the case at said opposing ends of said base structure;

a plurality of alignment structures disposed in said first and second end faces, each alignment structure exclusively comprising an aperture;

a plurality of alignment elements removably positioned snugly within a plurality of said apertures, said plurality of alignment elements configured for interacting with a second alignment structure of a second identical display case, wherein said first and second display cases can be aligned to form a single extended display case;

display lighting disposed within said first display case, wherein at least one of said plurality of alignment elements further comprises electrical circuitry for coupling electric power from said first display case to said second display case;

a plurality of posts; and a mesh material coupled to said posts to form a fence, said fence extending adjacent to said back panel so as to be visible from a front of said first display case.

* * * * *